US005769295A

United States Patent [19]

Alves

[11] Patent Number: 5,769,295

[45] Date of Patent: Jun. 23, 1998

[54] BACK PACK HOLDER

[76] Inventor: Kasidy W. Alves, 3115 Harbor Blvd., Oxnard, Calif. 93035

[21] Appl. No.: 754,160

[22] Filed: Nov. 22, 1996

[51] Int. Cl.[6] ..... A45F 3/02

[52] U.S. Cl. ..... 224/613; 224/578; 224/644

[58] Field of Search ..... 224/613, 578, 224/643, 644, 264, 614, 642

[56] References Cited

U.S. PATENT DOCUMENTS

| | | | |
|---|---|---|---|
| D. 315,825 | 4/1991 | Hutton et al. . | |
| D. 333,565 | 3/1993 | Imbert . | |
| 447,669 | 3/1891 | Dwyer . | |
| 2,089,474 | 8/1937 | Glick . | |
| 2,224,568 | 12/1940 | Altorfer . | |
| 3,549,064 | 12/1970 | Wilson . | |
| 4,262,385 | 4/1981 | Norman . | |
| 4,826,060 | 5/1989 | Hollingsworth | 224/613 |
| 5,187,823 | 2/1993 | Ferguson et al. . | |
| 5,203,482 | 4/1993 | Puff | 224/264 X |
| 5,526,969 | 6/1996 | Greenberger | 224/613 X |
| 5,577,652 | 11/1996 | Cooper | 224/578 |

FOREIGN PATENT DOCUMENTS

| | | | |
|---|---|---|---|
| 244216 | 3/1947 | Switzerland | 224/613 |

*Primary Examiner*—Renee S. Luebke
*Attorney, Agent, or Firm*—William W. Haefliger

[57] ABSTRACT

A back pack holder, comprising an elongated strap having upper and lower ends, the strap upper end operatively connected to the upper extent of the back pack, and the strap lower end selectively connectible to either one of two lower extents of the back pack, the strap having a width which widens along the strap length toward the upper end.

12 Claims, 5 Drawing Sheets

BACK PACK HOLDER

BACKGROUND OF THE INVENTION

This invention relates generally to back packs, and holders, such as carrying straps, for such packs. More particularly, it concerns an integrated pack and holder strap which concentrates and distributes pack imposed loading in such manner as to enhance or maximize the wearer's comfort.

There is continued need for improvements in back packs. There is also need for a back pack single strap holder that will enable ready changeability of wearing of the strap on the left or right shoulder of the user, and will concentrate and distribute loading at the selected shoulder area, to maximize comfort. There is also need for back pack holders such as straps or slings which will facilitate ease of placement on a single shoulder, and ease of removal off that shoulder.

SUMMARY OF THE INVENTION

It is a major object of the invention to provide an improved load distributing back pack, and single holder or sling, which meets the needs referred to above. Basically the improved holder comprises a) an elongated strap having upper and lower ends, the strap upper end operatively connected to upper extent of the back pack, and the strap lower end selectively connectible to either one of two lower extents of the back pack, b) the strap also having width which widens along the strap length toward its upper end, to distribute loading on the wearer's single shoulder carrying the pack.

It is another object to provide such a holder wherein strap width increases progressively along the major length of the strap length, toward its upper end, as for example from about two inches to at least about five inches, along the strap length toward that upper end. Such an improved tapered strap may typically be padded, for multiple purposes as will appear.

Another object is to provide a back pack having front and rear panels, the strap connected to upper and lower extents of said back panel, the rear panel having width which decreases in an upward direction, toward upper extent of the rear panel. The tapered strap typically has maximum width near the back panel upper extent, at its widthwise mid-region.

A further object is to provide a back panel rear panel which is a continuation of the tapered strap, and wherein the back panel strap narrows in width upwardly toward the upper extent of the strap. In this regard, the strap and back panel may be unitary, the upper extent of the strap defining a self supporting area, for ease of application to the wearer's shoulder, and removal.

Another object is to provide alternative lower first connectors on the back pack, to which the strap lower end is alternately connectible. A second connection may be provided to be releasably connectible to such first connectors, alternatively. The strap lower end carries the second connector; and a buckle connection may be used between the strap lower end and the second connector, to adjust strap length .

Accordingly, back pack panel loading is concentrated upwardly, due to taper of that panel toward arching extent of the strap, the strap widening at its upper arching extent to distribute loading to the wearer's shoulder, and lower extent of the strap may narrow downwardly to fit nicely between the wearer's arm and body side, under the shoulder, and to connect alternate rear side portions of the pack. Therefore, the strap may easily adapt to either shoulder of the wearer, to "sling support" the pack, comfortably, and with assured sack support, to remain at the wearer's back.

These and other objects and advantages of the invention, as well as the details of an illustrative embodiment, will be more fully understood from the following specification and drawings, in which:

DRAWING DESCRIPTION

DETAILED DESCRIPTION

Figure 1:
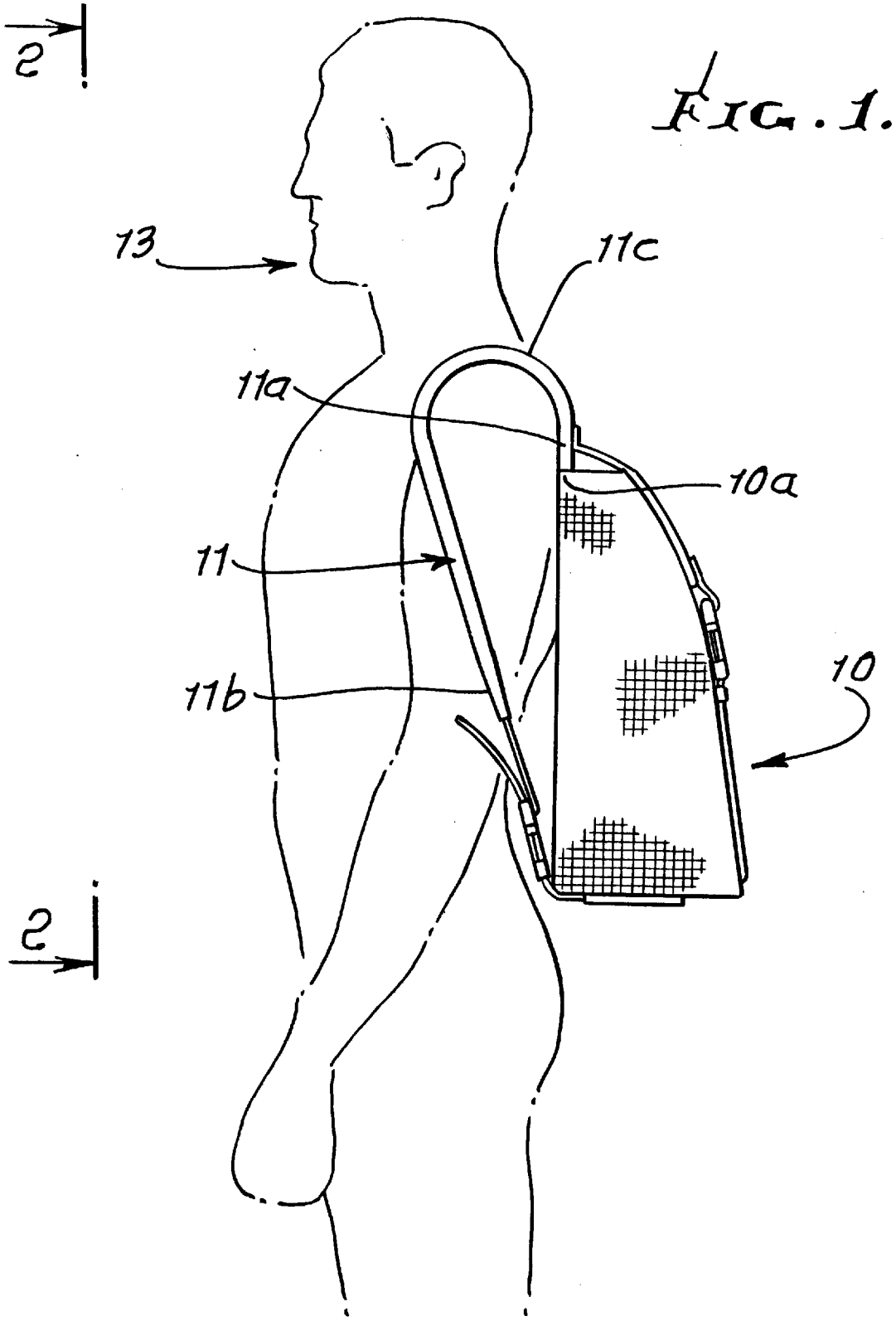
FIG. 1 is a side view of the pack with support strap worn on the left shoulder of the user.
Figure 2:
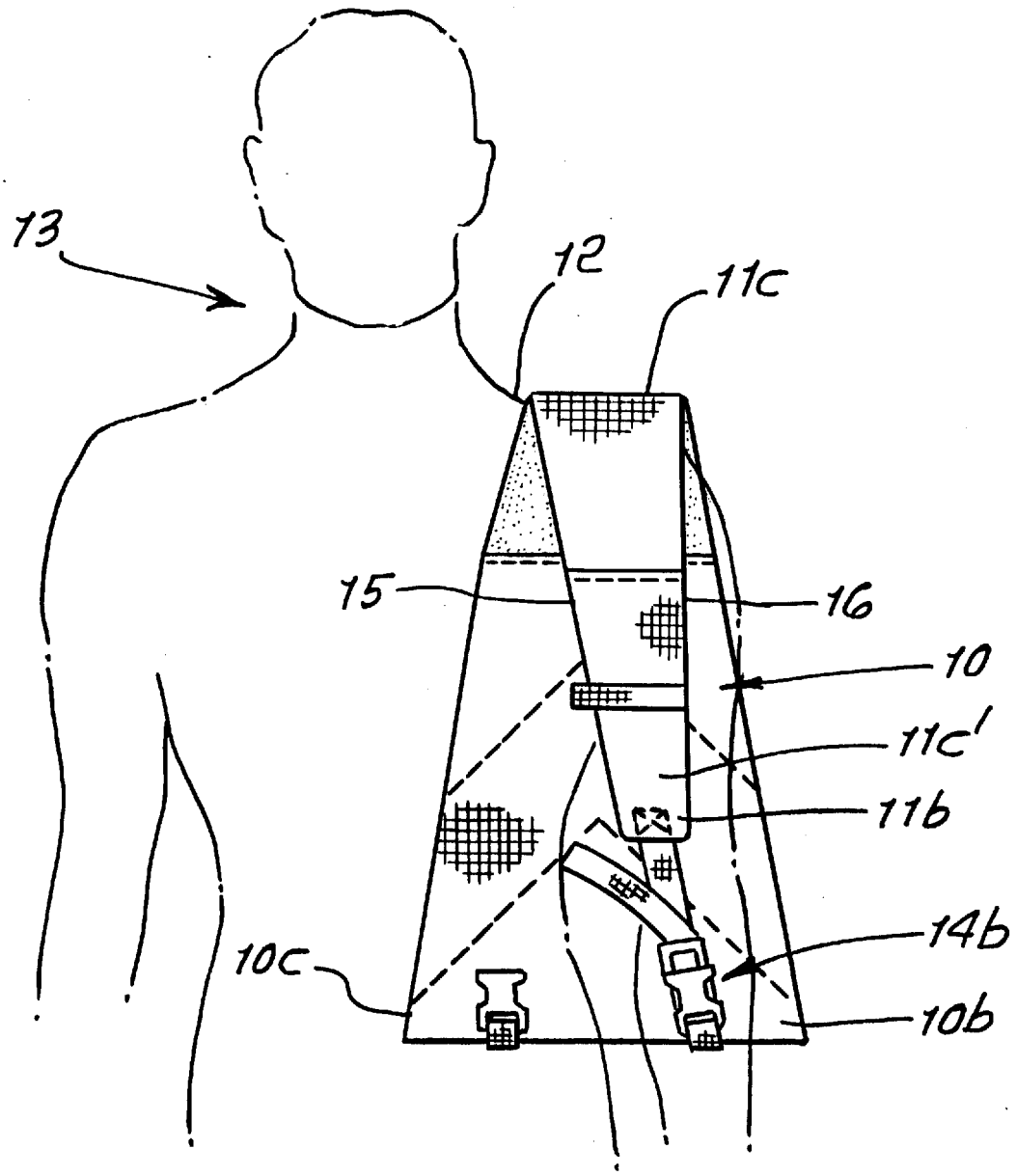
FIG. 2 is an elevation taken on lines 2—2 of FIG. 1.
Figure 3:
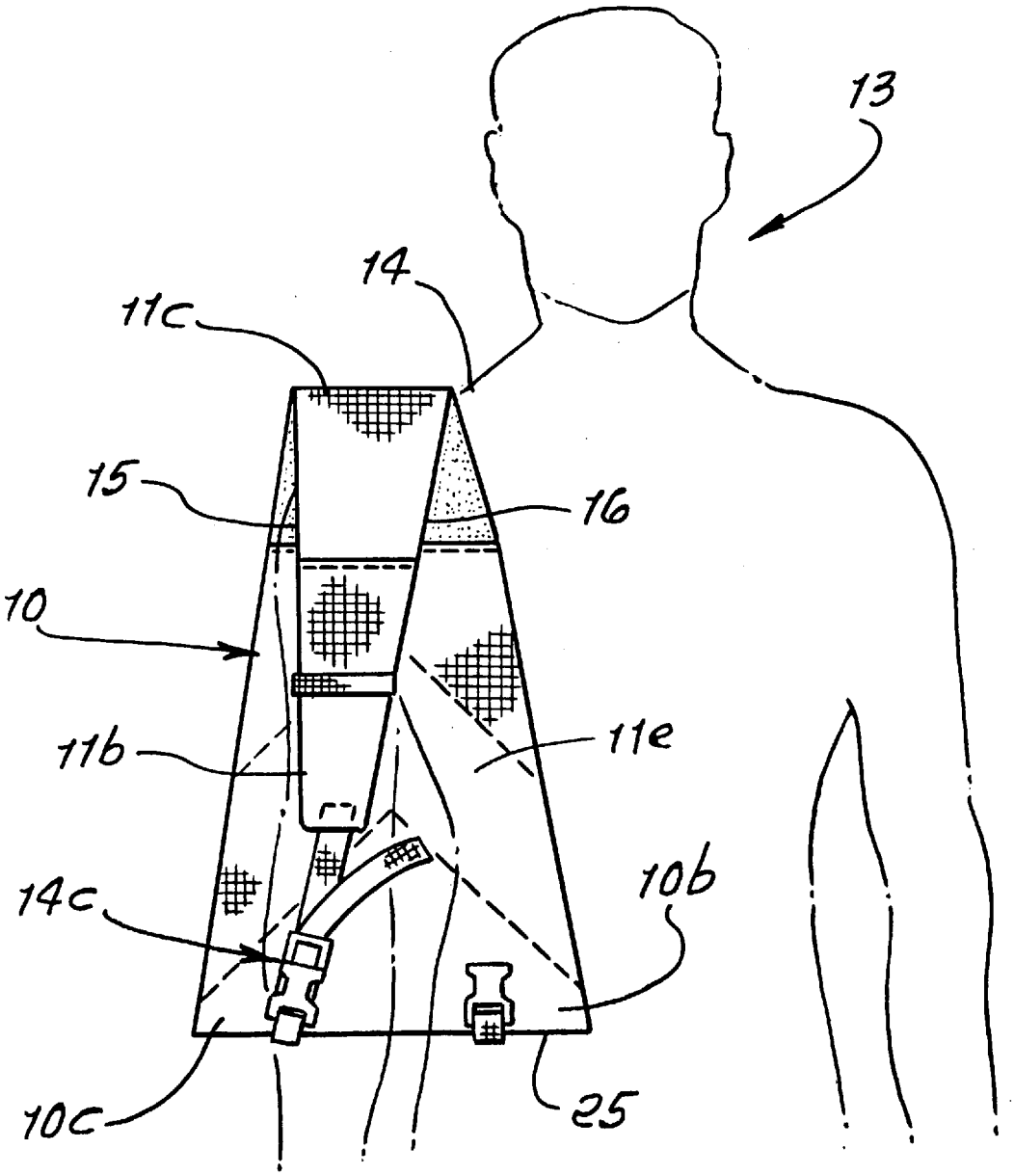
FIG. 3 is a view like FIG. 2, showing the pack support strap as alternatively worn on the right shoulder of the user.

In the drawings, a holder for a back pack 10 comprises an elongated upright strap 11 having upper end 11*a* and lower end 11*b*. The strap upper end 11*a* is connected to upper extent of the back pack, as at front top location 10*a*; and the strap lower end 11*b* is selectively connectible to either one of two lower portions or extents of the back pack. For example, FIG. 2 shows the strap upper portion 11*c* worn on the left shoulder 12 of the wearer 13 with the strap lower end 11*b* operatively connected to the left front lower extent 10*b* of the pack; and FIG. 3 shows the strap widened upper extent 11*c* worn on the right shoulder 14 of the wearer 13, with the strap lower end 11*b* operatively connected to the right front lower extent 10*c* of the pack. Vertically distributed loading of the upwardly widening strap, with upper widened portion 11*c* of the strap seated on the approximately horizontal left shoulder of the wearer as in FIG. 2, and with the lower end of the strap oriented toward a connection generally indicated at 14*b* at the left front lower extent 10*b* of the loaded pack, assures that the right front lower extent 10*c* of the pack will lie or come to rest or reside at the rear of the wearer's back; and similarly, vertically distributed loading of the upwardly widening strap, with upper widened portion 11*c* of the strap seated on the approximately horizontal right shoulder of the wearer, as in FIG. 3, and with lower end of the strap oriented toward a connection generally indicated at 14*c* at the right front lower extent 10*c* of the pack, assures that the left front lower extent 10*b* of the pack will lie or come to rest at the rear of the wearer's back, and with maximum comfort, assuring ease of removal from either FIG. 2 or 3 positions.

The strap has upwardly diverging opposite edges, as seen at 15 and 16 in FIGS. 2 and 3, and its width progressively increases along major length of the strap length toward its upper end 11*a*. Such width typically increases from about two inches, for example at or proximate the strap lower end extent 11*c*', to at least about five inches, for example at or proximate the strap upper extent or portion 11*c* which arches as shown over the wearer's shoulder. Such widening is preferably progressive, along major length of the strap. The arch is typically substantially self-supporting to maintain its arching configuration after removal off the wearer's shoulder. Such self support is typically created by heavy padding of the strap, particularly at the arch region, to allow arch self-support along with ease of comfortable accommodation to the wearer's top shoulder arch configuration, as when a heavy pack is worn. This is enhanced by the extreme width of the strap at the arch region. The self-support of the arched region provides accessibly open sides, left and right, for ease of side entry of either arm of the wearer, below the arch, to quickly support the pack, thus its wearer can easily and quickly shift the pack between FIGS. 2 and 3 positions, for maximum comfort.

Figure 5:
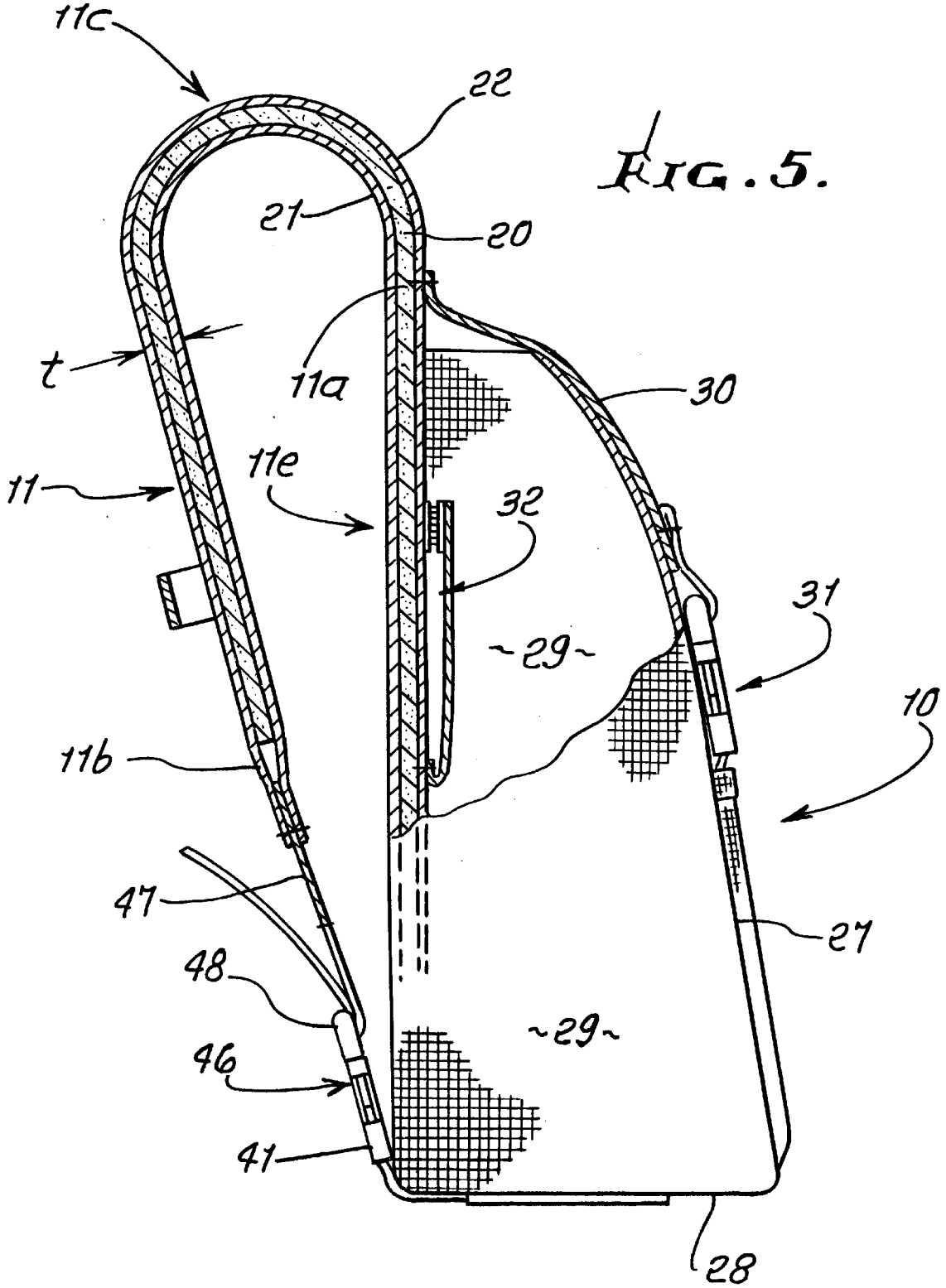
FIG. 5 is a section taken on lines 5—5 of FIG. 4.

The strap has thickness "t" between about ¼ inch and ⅝ inches along its length, and at its arched region, as shown in FIG. 5. Also, the strap is somewhat flexible along its length. For this purpose, the strap typically consists of a flexible but substantially shape retaining padding layer 20 sandwiched between two outer thinner, synthetic, flexible, and durable fabric layers 21 and 22, this composite with widening at arched region 11*c* assuring the self-supporting characteristics of the widened arched upper region. Padding layer 20 may consist of synthetic material, such as foam padding.

The widening of the strap towards arched region 11*c* serves a further purpose, in that the rearward and downward extent of the strap proximate 11*a* in FIG. 5 may advantageously be continued downwardly at 11*e*, to serve as the front panel of the back pack. Note the continued downward widening of that panel in FIG. 3, toward the bottom 25 of the pack. Since the panel 11*e* padded construction corresponds to that of the strap 11, there is continuity of pad support of pack loading, not only at the wearer's shoulder, but also at his back against which panel 11*e* bears. Thus, the panel 11*e* may be regarded as a functional continuation of the padded strap. Pack and strap construction simplicity are also provided.

Back pack rear fabric panel 27, bottom panel 28, and side panels 29 are also seen in FIG. 5. A pack fabric lid is provided at 30, and a clip 31 holds the lid closed. An interior pocket appears at 32.

Figure 4:
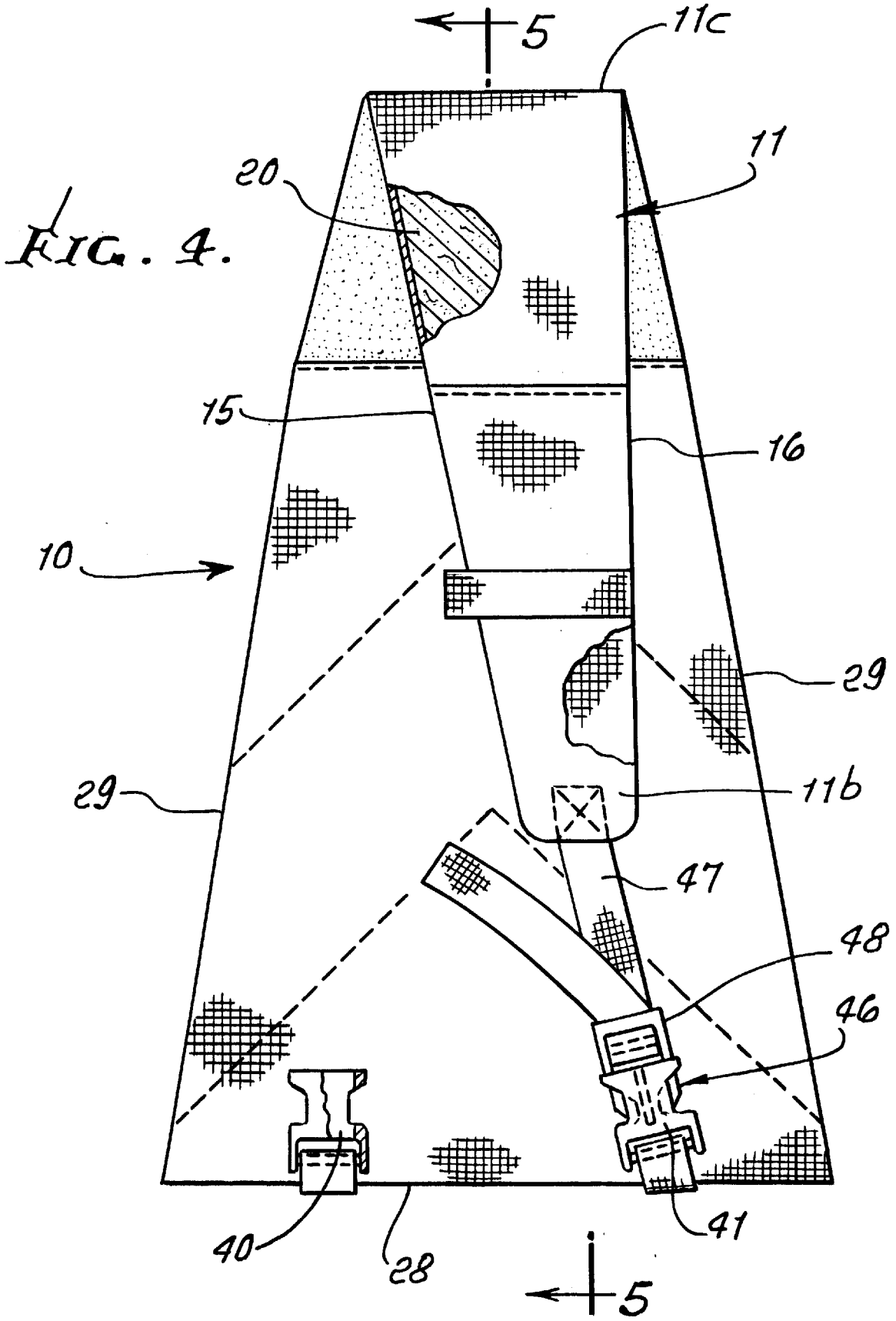
FIG. 4 is an enlarged elevation showing the front side of the pack and strap.

Also provided are alternative lower front connections, as at 40 and 41, attached to pack bottom panel 28 as seen in FIGS. 2–4. The strap lower end 11*b* is selectively connectible to such connections, as at 14*b* and 14*c* previously described. For these purposes, a second connector 46 is releasably connectible to the first connectors, alternately, and the strap lower end 11*b* carries connector 46, as via a web 47 and buckle 48 to adjust the spacing of the connector 46 from the strap lower end 11*b*. Connector 46 may be releasably insertible and attachable into first connectors 40 and 41, as by known mechanism, as commonly used on luggage.

I claim:

1. A back pack comprising a) an elongated strap having upper and lower ends, the strap upper end operatively connected to an upper extent of the back pack, and the strap lower end selectively connectible to either one of two lower extents of the back pack, b) said strap having a width which widens along the strap length toward said upper end, c) said back pack having front and rear panels, the rear panel having a width which decreases in an upward direction, toward an upper extent of the rear panel and the strap, d) said strap and rear panel having unitary sandwich construction, including a padding layer sandwiched between layers of synthetic durable fabric.

2. The back pack of claim 1 wherein said strap width increases progressively along the strap length, toward said upper end.

3. The back pack of claim 1 wherein said strap width increases from about two inches to at least about five inches, along the strap length toward said upper end.

4. The back pack of claim 1 wherein the strap is flexible along a major length thereof and has thickness between about ¼ inch and ⅝ inch.

5. The back pack of claim 1 wherein the strap has a maximum width proximate the uppermost extent of said rear panel.

6. The back pack of claim 5 wherein the strap maximum width exceeds about 5 inches.

7. The back pack of claim 5 wherein said strap width increases progressively along the strap length, toward said upper end.

8. The back pack of claim 7 wherein said strap width increases from about two inches to at least five inches, along the strap length toward said upper end.

9. The back pack of claim 7 wherein the strap is flexible along a major length thereof and has thickness between about ¼ inch and ⅝ inch.

10. The back pack of claim 1 wherein said strap has a lower end and there are alternative lower first connectors on said back pack, to which said strap lower end is alternatively connectible.

11. The back pack of claim 10 including a second connector releasably connectible to said first connectors, alternatively, and the strap lower end carries said second connector.

12. The back pack of claim 11 including a buckle connection between said strap lower end and said first connector.

* * * * *